United States Patent [19]

Ventz

[11] Patent Number: 4,846,306

[45] Date of Patent: Jul. 11, 1989

[54] FLEXIBLE, NARROW RUNG ROPE LADDER FOR EMERGENCY ESCAPE

[76] Inventor: Julius Ventz, Sendlinger Str. 75, D-8000 Munchen 2, Fed. Rep. of Germany

[21] Appl. No.: 90,525

[22] PCT Filed: Nov. 21, 1986

[86] PCT No.: PCT/DE86/00475

§ 371 Date: Sep. 2, 1987

§ 102(e) Date: Sep. 2, 1987

[87] PCT Pub. No.: WO87/03328

PCT Pub. Date: Jun. 4, 1987

[30] Foreign Application Priority Data

Nov. 27, 1985 [DE] Fed. Rep. of Germany ..... 8533417
Jun. 13, 1986 [DE] Fed. Rep. of Germany ..... 8615917

[51] Int. Cl.[4] ..... E06C 1/56
[52] U.S. Cl. ..... 182/196; 182/206
[58] Field of Search ..... 182/100, 190, 196, 194, 182/198

[56] References Cited

U.S. PATENT DOCUMENTS

| | | | |
|---|---|---|---|
| 271,796 | 2/1883 | Converse | 182/198 |
| 318,293 | 5/1885 | Rensch | 182/190 |
| 590,475 | 9/1897 | Buckley | 182/197 |
| 2,616,608 | 11/1952 | Bellamy . | |
| 2,927,329 | 3/1960 | Johannis | 182/196 |
| 3,294,196 | 12/1966 | Rabelos . | |
| 3,385,399 | 5/1968 | Burt . | |
| 4,405,034 | 9/1983 | Dunne . | |
| 4,475,628 | 10/1984 | Heilskov . | |
| 4,509,617 | 4/1985 | Lapeyre | 182/194 |
| 4,577,726 | 3/1986 | Wheeler | 182/100 |

FOREIGN PATENT DOCUMENTS

| | | | |
|---|---|---|---|
| 728930 | 4/1932 | France | 182/196 |
| 02541 | 7/1984 | PCT Int'l Appl. . | |
| 253834 | 6/1926 | United Kingdom . | |
| 599349 | 3/1948 | United Kingdom . | |

*Primary Examiner*—Reinaldo P. Machado
*Attorney, Agent, or Firm*—Owen J. Meegan

[57] ABSTRACT

A flexible narrow rung rope escape ladder including a pair of parallel support ropes and a series of narrow rungs disposed between the support ropes, the support ropes being spaced from each other such that a user's foot placed on the rung cannot slip sideways during use and no more than one hand or one foot can be placed on a rung at a time.

8 Claims, 2 Drawing Sheets

FLEXIBLE, NARROW RUNG ROPE LADDER FOR EMERGENCY ESCAPE

FIELD OF THE INVENTION

This invention concerns a rope escape ladder which can serve for rescue to allow persons to escape from buildings in which there is a fire or other dangerous situations.

SUMMARY OF THE INVENTION

The invention proposes to facilitate the escape of persons who normally are not skilled in the use of rope ladders. According to the invention, the rope escape ladder uses cross pieces or rungs which are narrow so that when a foot (or shoe) is placed on a rung, it cannot slip sideways.

Due to the design of the ladder of the present invention, the foot of a descending person has a secure hold in the lateral direction on the rung because the edges of the foot (or shoe) engage the parallel supporting ropes that are attached to the ends. Moreover, the person descending cannot simultaneously put two hands on one rung or two feet on another rung. The design is such that the spacing of the rungs is a multiple of their length. Because of the narrow width, that is one which will accommodate only a single foot or a single hand, the weight of a person using the ladder will be evenly distributed over the centerline of the ladder. This centerline is medially located between the parallel supporting ropes. Because of the forced relationship of the hands and the feet, the weight of the person is disposed over the centerline of the ladder with only one hand or one foot being placeable on any of the rungs at a time, the ladder does not swing singificantly to the left or to the right or forward or backwards.

The rope that is used for the ladder can be produced from various materials, for example, natural or synthetic fibers or stranded wire. The rungs are advantageously fastened to the ropes by fastening means such as bolts or nails and when stranded rope of synthetic materials are used, the rungs can be welded to the supporting ropes. The rungs are preferably designed as treads which can be formed of conventional materials such as plastic or aluminum. Expeditiously, the supporting ropes are provided with a spring safety hook at its upper end for holding it.

DESCRIPTION OF THE PREFERRED EMBODIMENTS

Figure 1:
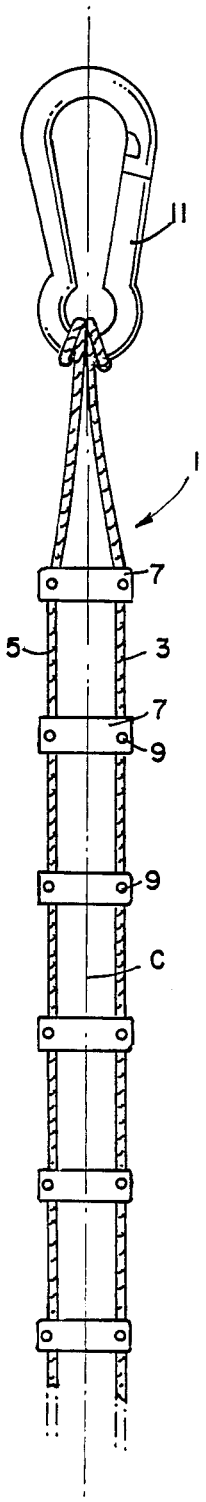
FIG. 1 is an elevational view of the rope escape ladder according to the present invention.

Referring to FIG. 1, a rope escape ladder is shown. A pair of ropes 3 and 5 are shown with rungs 7 designed as treads. The rungs 7 are fastened to the ropes 3 and 5. In this embodiment, fasteners 9 hold the rungs in a predetermined location relative to the ropes 3 and 5.

The ladder 1 is provided at its upper end with a safety spring hook 11 which can be fastened, for example, to any solid object in a building, for example, a heating radiator.

The treads 7 are fastened to the supporting ropes 3 and 5 at regular intervals at a normal stepping height.

Because of the narrowness of the treads 7, no more than one foot or one hand at a time can be placed on any of them. Thus, the foot cannot slip sideways because the movement is immediately stopped by one of the supporting ropes 3 or 5. The rungs space the ropes 3 or 5 equidistantly from a centerline C. Because of the forced relationship of the hands and the feet with the weight of the body being disposed over the centerline C, and with only one hand or one foot being placeable on any of the rungs at a time, the ladder does not swing significantly to the left or the right or forward or backing during use. The weight of the person will be evenly distributed over the centerline C which is medially located between the ropes. The supporting ropes 3 and 5 can be formed of twisted fibers which can also be braided and can be formed of natural or synthetic materials.

Figure 2:
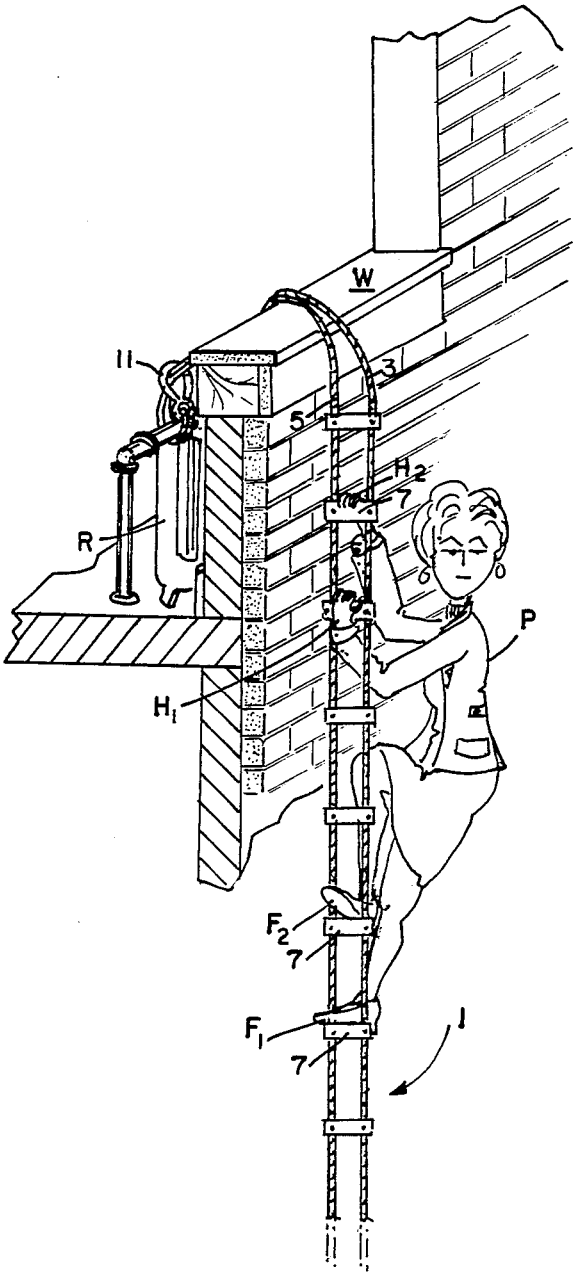
FIG. 2 is a perspective view, with elements shown in cross-section, of a person climbing on the rope escape ladder from a window.

Referring now to FIG. 2, a person P is shown descending the ladder 1 with a first foot F1 and a second foot F2 disposed on each of the rungs 7. Also, the person has hands H1 and H2 disposed on rungs 7. As shown, the rungs are narrow and can accommodate only one hand or one foot at a time. The supporting ropes 3 and 5 are joined together at their ends and are attached to a spring safety hook 11 which is wrapped around a pipe leading to a radiator R. The rope is slung over a windowsill W that is disposed in a wall of a building.

It is apparent that modifications and changes can be made within the spirit and scope of the present invention but it is my intention, however, only to be limited by the scope of the appended claims.

As my invention, I claim:

1. A flexible, narrow rung, rope escape ladder, said ladder comprising:

a pair of longitudinally extending parallel supporting ropes;

an initial narrow rung attached to said parallel supporting ropes;

a series of narrow rungs of substantially the same width as said initial narrow rung, said rungs being longitudinally spaced substantially equidistantly from each other whereby to form said ladder;

said pair of supporting ropes being spaced from each other by said rungs such that a person's foot placed on a rung cannot slip sideways during use and no more than one hand or one foot can be placed on a rung at a time;

said supporting ropes having an initial segment disposed above said initial narrow rung, said initial segment being formed of said supporting ropes, the supporting ropes forming said initial segment being joined together, the length of each of the supporting ropes forming the initial segment being substantially equal, whereby said ladder can be secured to enable it to be used.

2. The rope escape ladder according to claim 1 wherein the supporting ropes are formed of natural fibers.

3. The rope escape ladder according to claim 1 wherein the supporting ropes are of wire rope.

4. The rope escape ladder according to claim 1 wherein the supporting ropes are of synthetic fibers.

5. The rope escape ladder according to any of claims 1, 2, 3 or 4 wherein the rungs are treads, said treads being formed of plastic or aluminum.

6. The rope escape ladder according to claims 1, 2, 3 4 or 5 wherein the ladder further includes a spring safety hook, said hook being disposed on said centerline of said initial segment.

7. The rope escape ladder according to claim 1 wherein the longitudinal space between said rungs is a multiple of the width between said supporting ropes.

8. The rope escape ladder according to claim 1 further including means to fasten said rungs to said supporting ropes.

* * * * *